US007337583B1

(12) United States Patent
Lohman et al.

(10) Patent No.: US 7,337,583 B1
(45) Date of Patent: Mar. 4, 2008

(54) EXTENDABLE DECK FOR SEATING SYSTEM

(75) Inventors: John M Lohman, Effingham, IL (US); Steven R Douglass, Broughton, IL (US)

(73) Assignee: Irwin Seating Company, Grand Rapids, MI (US)

( * ) Notice: Subject to any disclaimer, the term of this patent is extended or adjusted under 35 U.S.C. 154(b) by 653 days.

(21) Appl. No.: 10/797,292

(22) Filed: Mar. 10, 2004

(51) Int. Cl.
*E04H 3/12* (2006.01)

(52) U.S. Cl. ..... 52/9; 52/7; 52/67; 52/183

(58) Field of Classification Search ..... 52/6, 52/8, 9, 10, 183, 184, 64, 67, 283; 472/92; 182/223

See application file for complete search history.

(56) References Cited

U.S. PATENT DOCUMENTS

| | | | | |
|---|---|---|---|---|
| 1,619,678 A | | 3/1927 | Prinz | |
| 2,888,182 A | * | 5/1959 | Nixon | 182/1 |
| 3,400,502 A | | 9/1968 | Scaggs et al. | 52/9 |
| 3,608,251 A | * | 9/1971 | Scaggs | 52/9 |
| 4,063,392 A | | 12/1977 | Van Ryn et al. | 52/9 |
| 4,155,202 A | | 5/1979 | Hartman | 52/9 |
| 4,361,991 A | * | 12/1982 | Wiese | 52/9 |
| 4,467,569 A | | 8/1984 | Blanchard et al. | 52/9 |
| 4,571,895 A | * | 2/1986 | Lyman, Jr. | 52/9 |
| 5,069,007 A | | 12/1991 | Paddock | 52/9 |
| 5,375,962 A | * | 12/1994 | Kempf | 414/541 |
| 5,559,411 A | | 9/1996 | Winship | |
| 5,653,502 A | | 8/1997 | Kimura et al. | 297/217.7 |
| 5,820,110 A | | 10/1998 | Beu | 256/59 |
| 5,921,031 A | | 7/1999 | Williams | 52/8 |
| 6,029,406 A | | 2/2000 | Staehlin | 52/9 |
| 6,050,366 A | * | 4/2000 | Lyons | 187/200 |
| 6,185,875 B1 | | 2/2001 | Victor et al. | 52/9 |
| 6,199,325 B1 | | 3/2001 | Winship | |
| 6,212,828 B1 | * | 4/2001 | McArthur, Jr. | 52/9 |
| 6,244,657 B1 | | 6/2001 | Momose | 297/217.7 |
| 6,298,801 B1 | | 10/2001 | May | 114/85 |
| 6,324,790 B1 | * | 12/2001 | Victor et al. | 52/9 |
| 6,502,893 B1 | | 1/2003 | Corliss, Jr. | 296/162 |
| 6,539,672 B1 | | 4/2003 | Frost | 52/9 |

FOREIGN PATENT DOCUMENTS

| | | | |
|---|---|---|---|
| JP | 03021775 A | 1/1991 | 52/9 |

* cited by examiner

*Primary Examiner*—Richard Chilcot
*Assistant Examiner*—William Gilbert
(74) *Attorney, Agent, or Firm*—Van Dyke, Gardner, Linn & Burkhart LLP

(57) ABSTRACT

An extendable deck assembly for a seating area includes a deck portion that is extendable from a base portion to provide a substantially planar support platform. The extendable deck assembly includes a support assembly positioned within the base portion and configured to support a cover plate of the base portion when the deck portion is extended from the base portion. The deck portion may telescopingly extend from the base portion and the support assembly may nest together to facilitate extension and retraction of the support assembly within the base portion. The extendable deck assembly may include a locking mechanism that may secure or lock the extendable deck in the extended position to limit or substantially preclude retraction of the deck portion relative to the base portion. The locking assembly may be part of a guard rail assembly positioned at least partially around the extendable deck portion.

26 Claims, 19 Drawing Sheets

EXTENDABLE DECK FOR SEATING SYSTEM

FIELD OF THE INVENTION

The present invention relates generally to a deck or platform of a seating system, such as bleachers or seats at a stadium or the like, and, more particularly, to an extendable deck or platform for supporting a wheel chair or the like at the seating system, whereby the extendable deck or platform may be retracted when not in use to allow other seats or chairs to be positioned at the area adjacent to the extendable deck or platform.

BACKGROUND OF THE INVENTION

It is known to provide extendable seating systems, where one or more levels of seats or platforms or tiers may be extended and retracted relative to one another to move the platform and the seats positioned thereon between a stored position and an extended or in-use position. The seats positioned at the tiers or platforms may be folded down to facilitate retraction of the platforms generally beneath the rearward or upper platform. Each of the platforms or tiers is typically a substantially rigid platform and may be a solid platform or may have supports therealong to limit or substantially preclude bending of the platforms under load.

Typically, a stadium or seating facility must have a required number of seats or percentage of seating area to accommodate handicapped people, such as people in wheel chairs and the like. It is often desirable to have such seating arrangements be temporary, so that wheel chair platforms or the like are available when needed, but other, upright seats or chairs may be provided in the areas when such platforms are not required. Often, folding chairs or other removable chairs may be used at a section or area of the stadium, such that the chairs may be readily removed when the platform area is needed. However, such seating arrangements are difficult to set up and require storing of the chairs when they are not in use.

SUMMARY OF THE INVENTION

The present invention provides an extendable deck or platform that is telescopingly extendable from a base portion, in order to provide an extended deck or platform for a wheel chair or the like at a position that is outward from the base portion. The base portion may be positioned rearward of the seats or chairs of a seating system, and the extendable deck or platform may extend outwardly from the base portion to be positioned generally at some of the seats, with the seats being folded down to a non-use position when the extendable deck is extended. The base portion may include one or more movable supports that support a cover plate of the base portion when the extendable deck is extended from the base portion and is no longer positioned beneath the cover plate of the base portion. The extendable deck or platform may be locked in an extended position to limit or substantially preclude retraction of the extendable deck during use. For example, the extendable deck may have a hand rail or side rail or guard rail extending along a side of a deck, and the rail may engage a portion of the base portion to substantially limit or preclude retraction of the deck portion.

According to an aspect of the present invention, an extendable deck assembly for a seating area having multiple tiers includes a base portion, a deck portion and a support assembly. The base portion has a lower surface, opposite walls and a cover plate, with the cover plate extending across and between the opposite walls and defining an upper surface of the base portion. The base portion thus defines a cavity between the opposite walls and between the cover plate and the lower surface. The deck portion is extendable and retractable between a retracted position, where the deck portion is positioned substantially within the cavity of the base portion, and an extended position, where the deck portion is at least partially extended from the base portion. The support assembly is arranged in the cavity of the base portion and includes a fixed end attached to the base portion and a movable end attached to the deck portion. The support assembly also includes at least one movable support that is movably engaged with the lower surface of the base portion and with the cover plate of the base portion. The movable support or supports is/are movable relative to the fixed end and is/are extendable and retractable with the deck portion. The movable support or supports is/are configured to substantially support the cover plate when the deck portion is in the extended position.

The movable supports may comprise a plurality of roller assemblies, with each of the roller assemblies having at least one lower roller that engages the lower surface of the base portion and at least one upper roller that engages the cover plate. The roller assemblies may be telescopingly movable relative to one another and may be nested together when the deck portion is in the retracted position.

According to another aspect of the present invention, a method for extending a deck at a seating area and for supporting a base portion cover when the deck is extended includes providing a base portion having a lower surface, opposite walls and a cover plate. The cover plate extends across and between the opposite walls and defines an upper surface of the base portion. The base portion defines a cavity between the opposite walls and between the cover plate and the lower surface. The method further includes providing a deck portion that is extendable and retractable between a retracted position, where the deck portion is positioned substantially within the cavity of the base portion, and an extended position, where the deck portion is at least partially extended from the base portion. The cover plate is supported by the extendable deck portion when the deck portion is in the retracted position. The cover plate is supported by a movable support assembly when the deck portion is at least partially extended from the base portion.

The cover plate may be supported by a movable support assembly arranged in the cavity of the base portion and inward of the deck portion. The movable support assembly may movably engage the lower surface of the base portion and the cover plate of the base portion as the deck portion is extended.

According to another aspect of the present invention, an extendable deck or platform assembly for a seating area having multiple tiers includes a base portion, a deck portion, a support assembly and a locking assembly. The base portion includes a lower surface, opposite walls and a cover plate, with the cover plate extending across and between the opposite walls and defining an upper surface of the base portion. The base portion defines a cavity between the opposite walls and between the cover plate and the lower surface. The deck portion is extendable and retractable between a retracted position, where the deck portion is positioned at least substantially within the cavity, and an extended position, where the deck portion is at least partially extended from the base portion. The deck portion may at least partially support the cover plate when the deck portion is in the retracted position. The support assembly is arranged in the cavity and comprises at least one movable support. The movable support is movable relative to the base portion and is extendable and retractable with the deck portion. The movable support is configured to substantially support the cover plate when the deck portion is extended. The locking assembly is configured to lock the extendable deck portion relative to the base portion when the deck portion is in the extended position.

The locking assembly may comprise a hand rail or guard rail or side rail assembly that is positionable at least partially along a side of the deck portion and is engagable with a mounting portion of a deck portion and a mounting portion of the base portion when the deck portion is in the extended position. The side rail assembly may include a substantially rigid locking portion that is positionable along the side of the deck portion when the deck portion is extended and is selectively engagable with the mounting portion at the base portion to substantially limit retraction of the deck portion relative to the base portion.

Therefore, the present invention provides an extendable deck portion that may be telescopingly extended and retracted relative to and within a base portion. The extendable deck is extendable from within the base portion, while one or more movable supports move outwardly to provide support of the cover plate of the base portion when the deck is extended therefrom. The base portion may be positioned rearward of a plurality of seats or seating system or arrangement, where the deck may extend outwardly from the base portion and the seats may fold down or may be removed to provide clearance and room for the extendable deck in its extended position. The extendable deck may be secured in the extended position by a locking mechanism or assembly, such as a hand rail or guard rail or the like that may extend along a side portion of the extended deck and may engage the base portion, in order to limit or substantially preclude retraction of the deck relative to the base portion. The present invention thus provides an extendable deck for a seating facility that may be selectively extended for situations when additional platform areas are desired, such as for people in wheel chairs and the like, and which may be retracted when not needed so that typical stadium seats or chairs or the like may be arranged at the extendable deck. The support of the cover plate of the base portion allows for people with wheel chairs to move over the base portion when the deck is extended therefrom, without sagging or bending or flexing of the cover plate of the base portion during such loading conditions with the deck extended.

These and other objects, advantages, purposes and features of the present invention will become more apparent upon review of the following specification in conjunction with the drawings.

DESCRIPTION OF THE PREFERRED EMBODIMENTS

Figure 1:
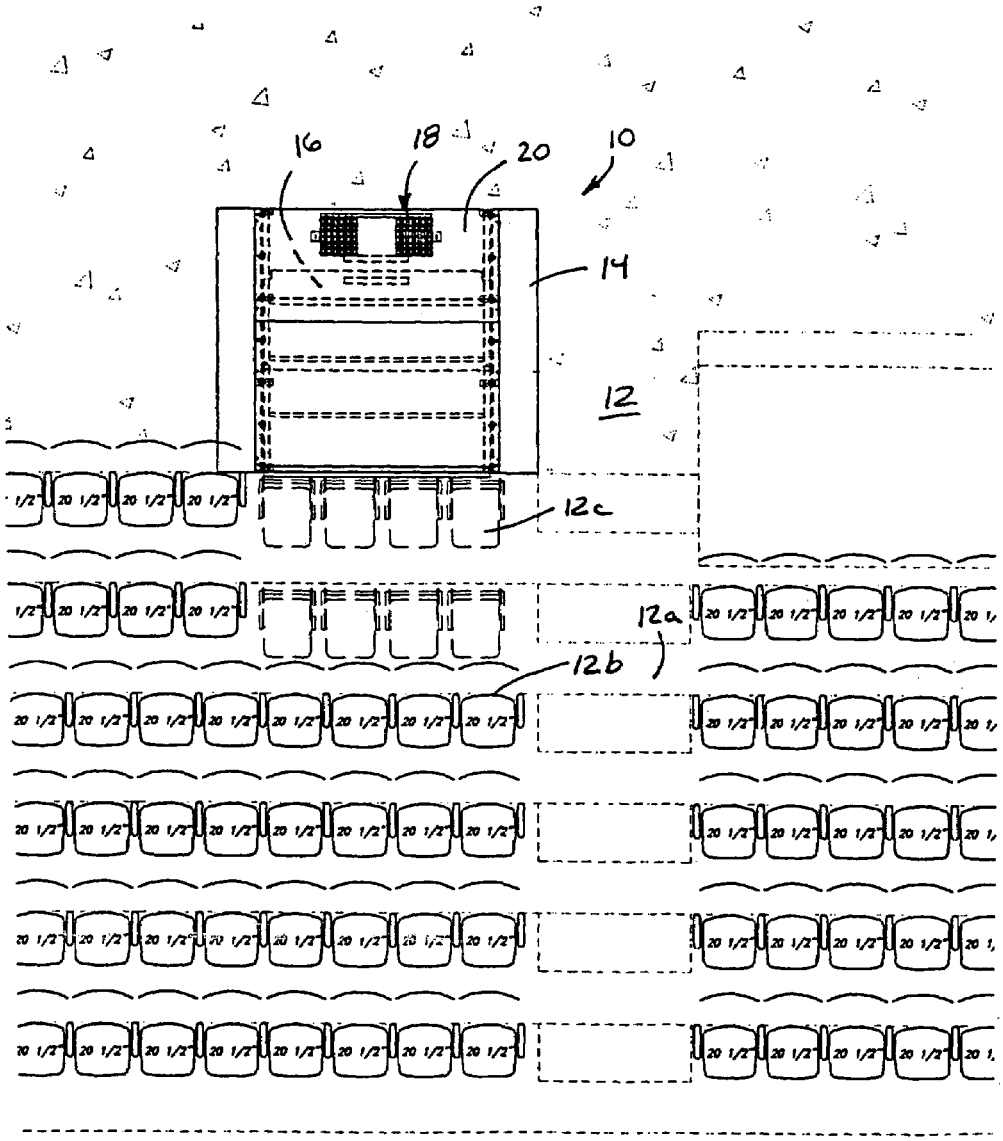
FIG. 1 is a plan view of a seating area that includes multiple seats or chairs and an extendable deck assembly in accordance with the present invention, showing the extendable deck in its retracted orientation.
Figure 2:
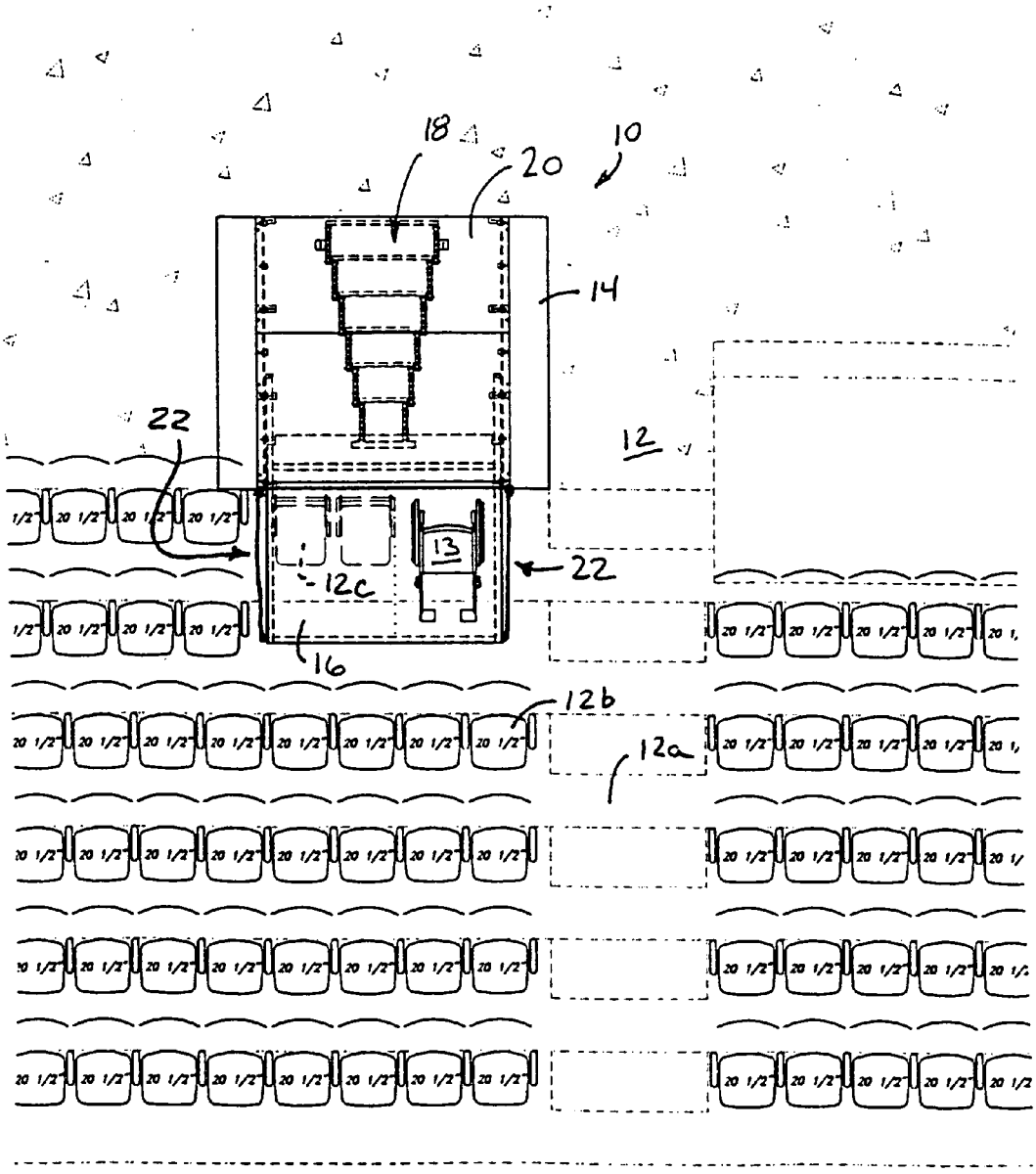
FIG. 2 is a plan view similar to FIG. 1, with the extendable deck assembly in its extended orientation.

Referring now to the drawings and the illustrative embodiments depicted therein, an extendable deck or platform assembly 10 is positioned at a seating area or facility 12 and includes a base portion 14 and a deck portion or platform 16 that is extendable and retractable relative to base portion 14 (FIGS. 1-4). The seating area or facility 12 may comprise multiple levels or tiers 12*a*, with each tier or level 12*a* having a row of multiple seats or chairs 12*b* positioned therealong. Seating area 12 may comprise a seating portion of a stadium or theater or the like for people viewing an event or show or the like at the seats or chairs 12*b*. Deck portion 16 may be telescopingly extendable and retractable or movable relative to base portion 14 between a retracted position (FIG. 1), where deck portion 16 is substantially within base portion 14, and an extended position (FIG. 2), where deck portion 16 substantially extends from base portion 14. Extendable deck assembly 10 may be positioned rearward of some of the seats 12*c* of seating facility 12, whereby extendable deck portion 16 may extend from base portion 14 to be positioned generally over and generally at the location of the some of the seats or chairs 12*c* (as shown in FIG. 2). Extendable deck assembly 10 includes a support assembly 18 for supporting a cover or cover plate 20 of base portion 14 when deck portion 16 is extended at least partially therefrom, as discussed below. Extendable deck assembly 10 may also include a locking device or mechanism 22 (FIG. 2) for limiting retraction of or substantially precluding retraction of deck portion 16 relative to base portion 14 when deck portion 16 is in its extended position, as also discussed below.

Figure 3:
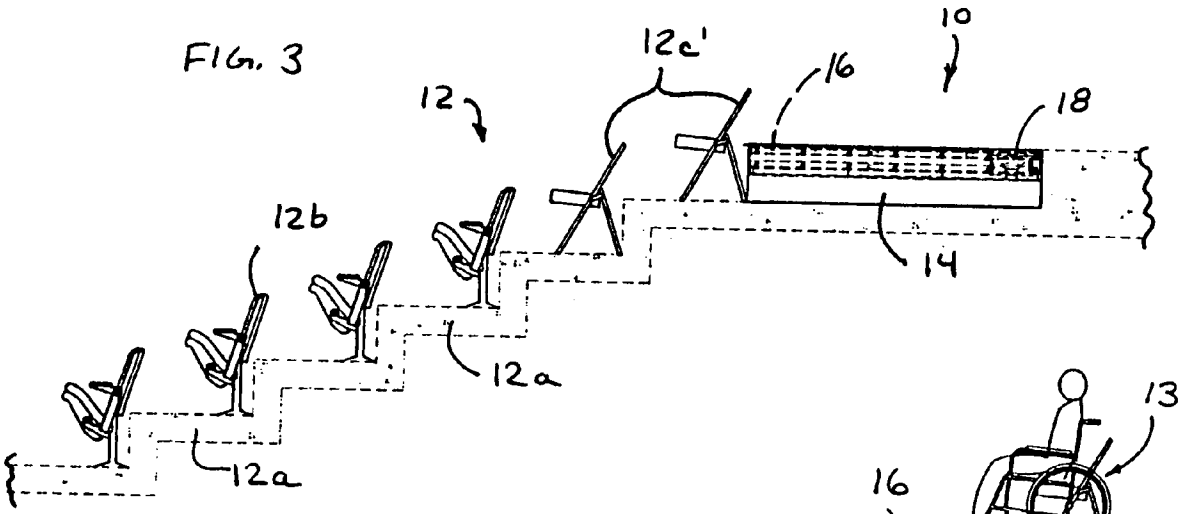
FIG. 3 is a side elevation of a seating area and extendable deck assembly arrangement in accordance with the present invention, with removable chairs being positioned in front of the retracted deck assembly.
Figure 4:
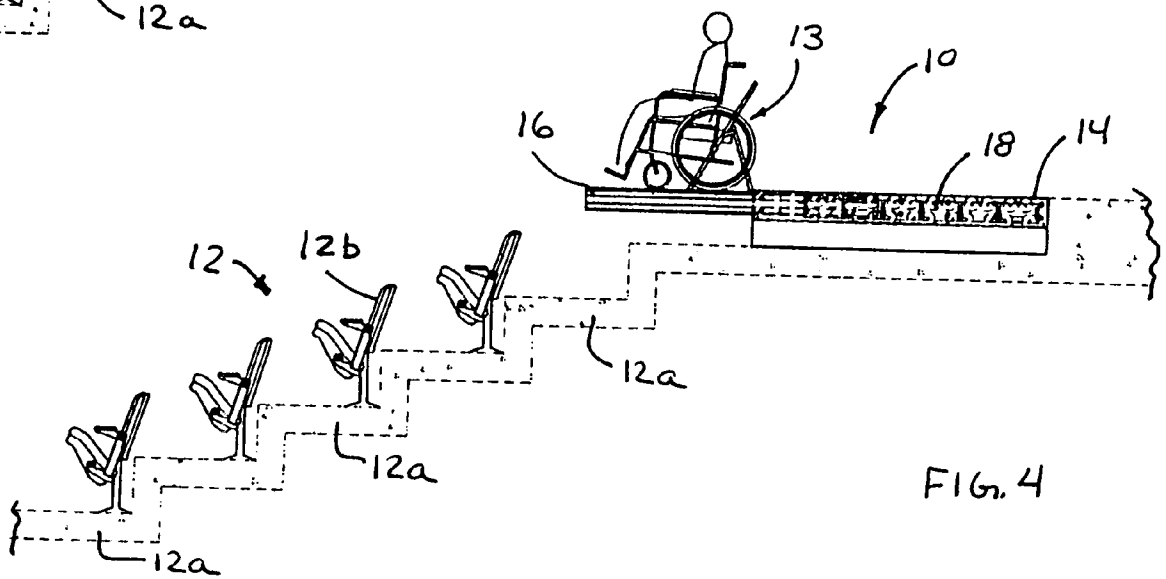
FIG. 4 is a side elevation similar to FIG. 3, where the extendable deck assembly is in its extended orientation and the removable chairs have been removed.
Figure 5:
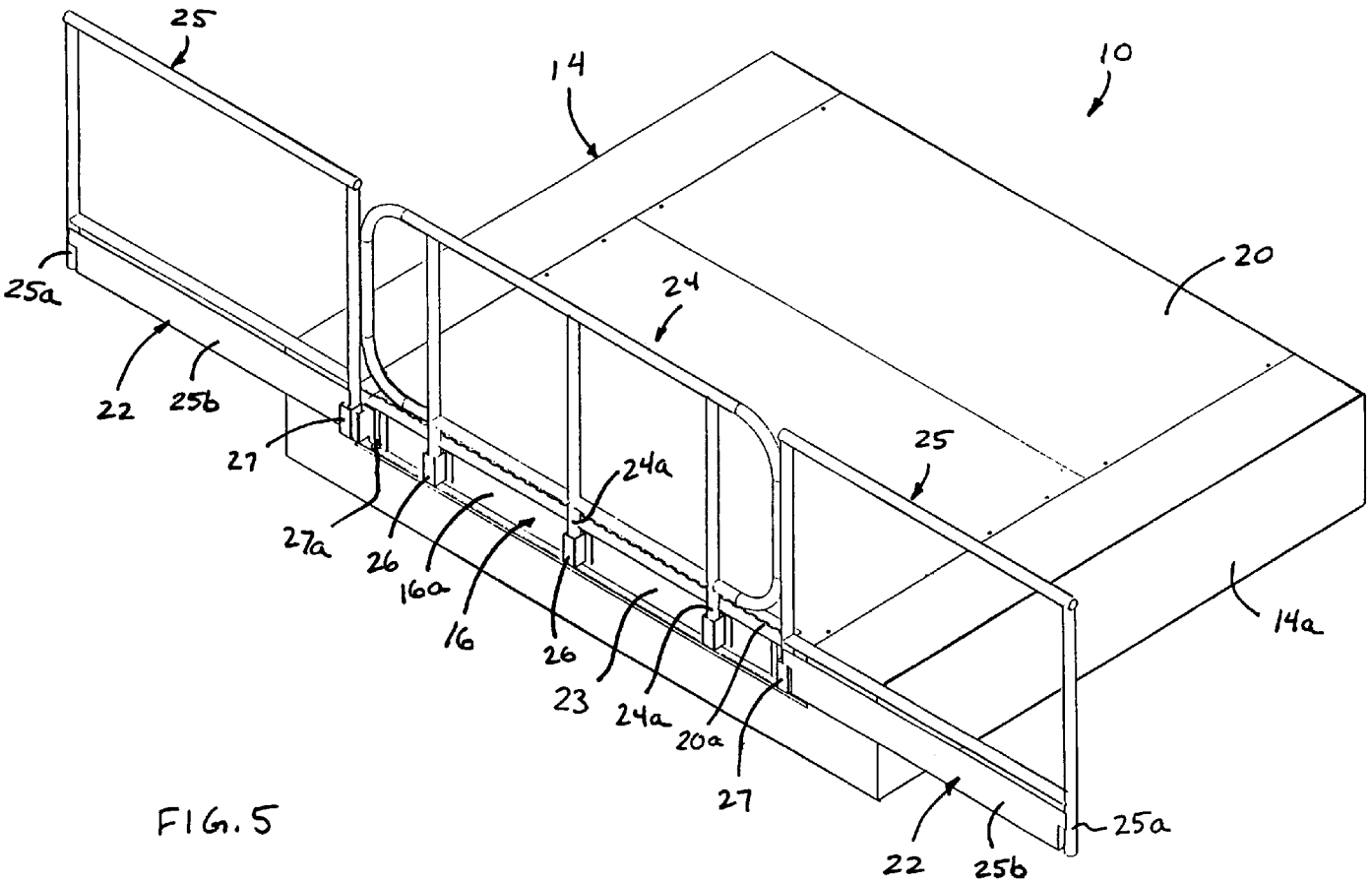
FIG. 5 is a perspective view of an extendable deck assembly in accordance with the present invention, with the extendable deck assembly in its retracted orientation.

In the illustrated embodiments of FIGS. 1 and 2, seats 12*c* in front of or at extendable deck assembly 10 may fold down or collapse to allow deck portion 16 to extend from base portion 14 and be positioned generally at or over the collapsed seats 12*c*. Optionally, and as shown in FIGS. 3 and 4, seats or chairs 12*c*' may be removably positioned at the tier or tiers 12*a*' in front of extendable deck assembly 10, whereby seats 12*c*' may be removed to allow deck portion 16 to extend from base portion 14. As can be seen with reference to FIGS. 2 and 4, deck portion 16 of extendable deck assembly 10 provides a deck or platform that is positionable at the seating area or region of the facility and that is wheel chair accessible, such that a person in a wheel chair 13 may sit at the extendable deck portion for viewing the event or show.

With reference to FIGS. 5-12, deck portion 16 may be movable relative to base portion 14 between a retracted position (FIGS. 5-8) and an extended position (FIGS. 9-12). Deck portion 16 is nestable within a cavity of base portion 14 and generally beneath cover plate 20, such that deck portion 16 may be substantially entirely within base portion 14 when in its retracted position. Deck portion 16 may provide support for cover plate 20 when deck portion 16 is in the retracted position, and support assembly 18 may support cover plate 20 when the deck portion 16 is extended, as discussed below. Deck portion 16 may include a guard rail or hand rail 24 to provide a safety rail around the deck to prevent people from falling off the deck assembly.

Guard rail or hand rail or the like 24 may be removably mounted along an outer end or portion 16*a* of deck portion 16. For example, guard rail 24 may include generally vertical support or mounting posts 24*a* which may extend into or be received within corresponding mounting brackets 26 positioned along outer portion 16*a* of extendable deck portion 16. Guard rail 24 may also include side guard rails 25, which may be positioned at side guard rail mounting brackets 27 mounted at opposite sides or corners of deck portion 16. Side guard rail mounting brackets 27 may be pivotable or hinged and may pivot about a pivot pin or axis or hinge 27*a*, such that side guard rails 25 may be pivoted to a desired location or orientation depending on the position or orientation of extendable deck portion 16, as discussed below. In the illustrated embodiment, brackets 26 and 27 are mounted to a face plate 23 (FIGS. 5, 8, 9, 12 and 13) that is mountable to the outer portion 16*a* of deck portion 16 to provide a substantially finished appearance to deck portion 16. Additionally, side guard rails 25 may include a lower side plate or panel 25*b* that may function to cover the side guard rail and side portions of deck portion 16 when deck portion 16 is extended from base portion 14, as discussed below.

Figure 9:
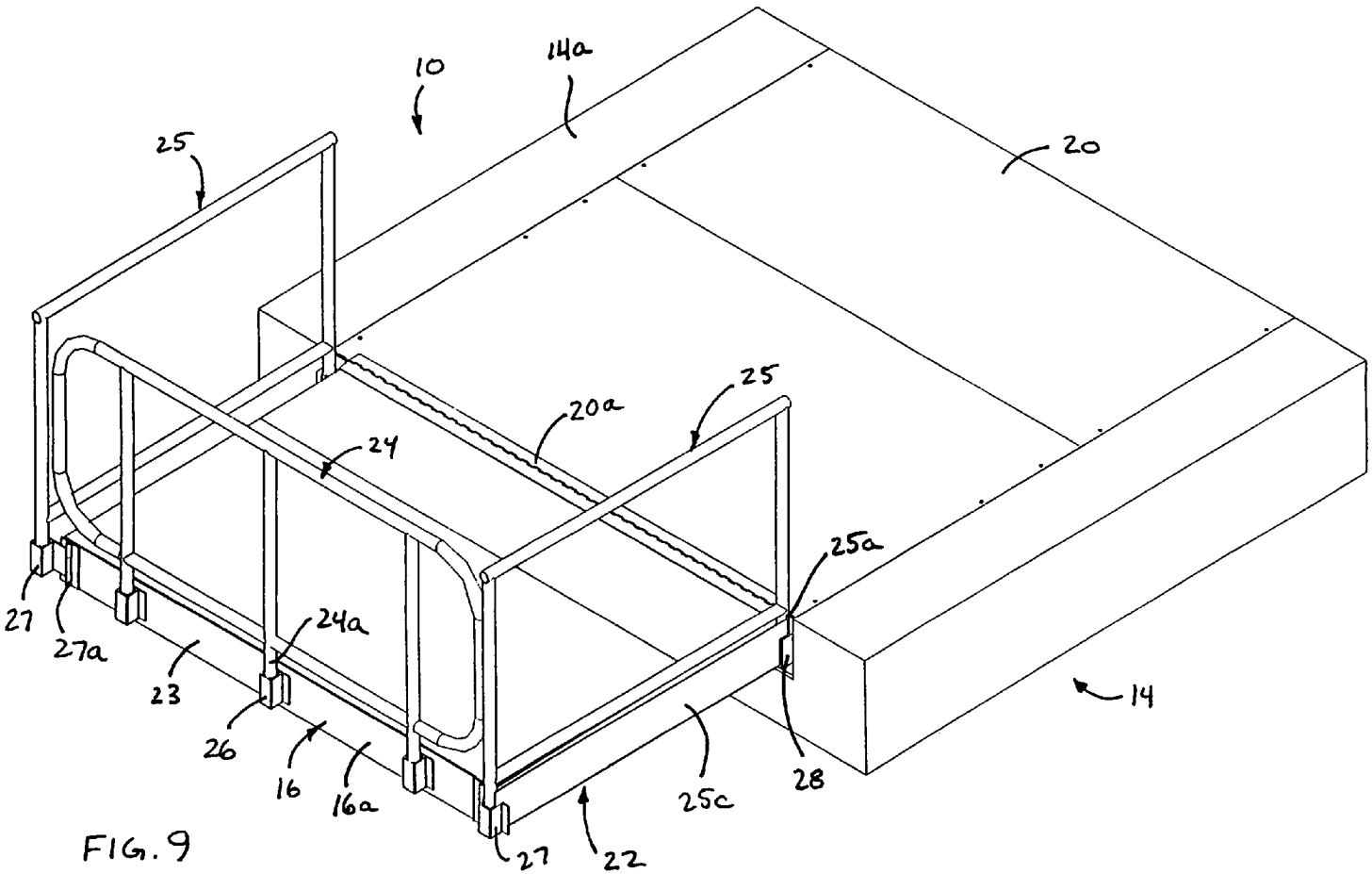
FIG. 9 is a perspective view of the extendable deck assembly of FIGS. 5-8, with the extendable deck assembly shown in its extended orientation.
Figure 10:
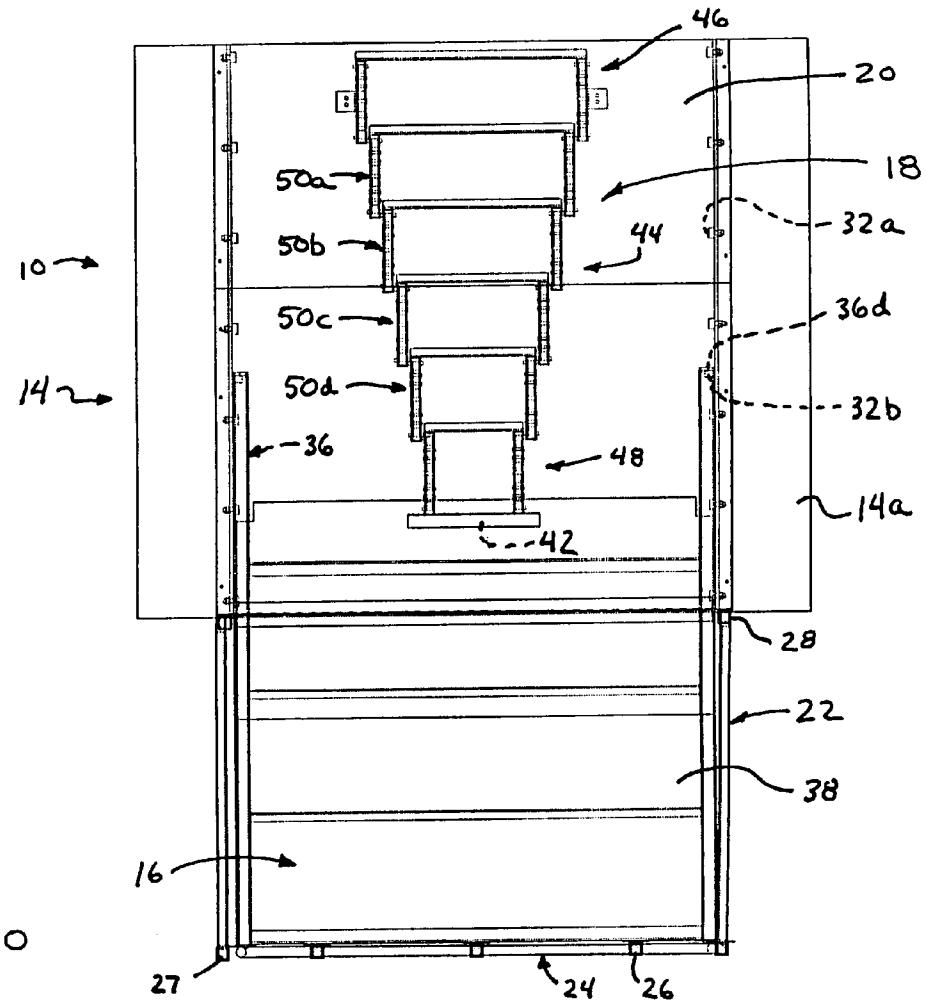
FIG. 10 is a plan view of the extendable deck assembly of FIG. 9.
Figure 11:
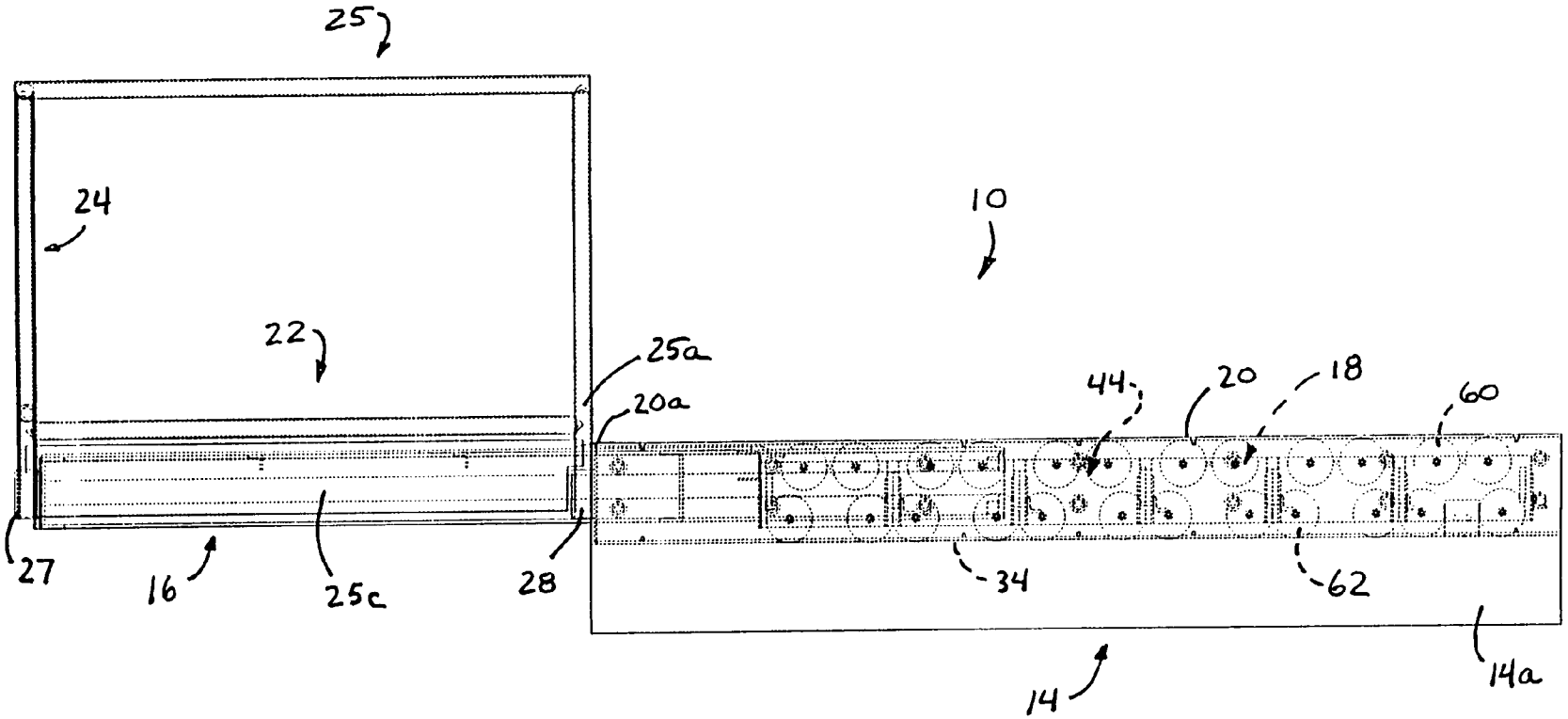
FIG. 11 is a side elevation of the extendable deck assembly of FIGS. 9 and 10.
Figure 12:
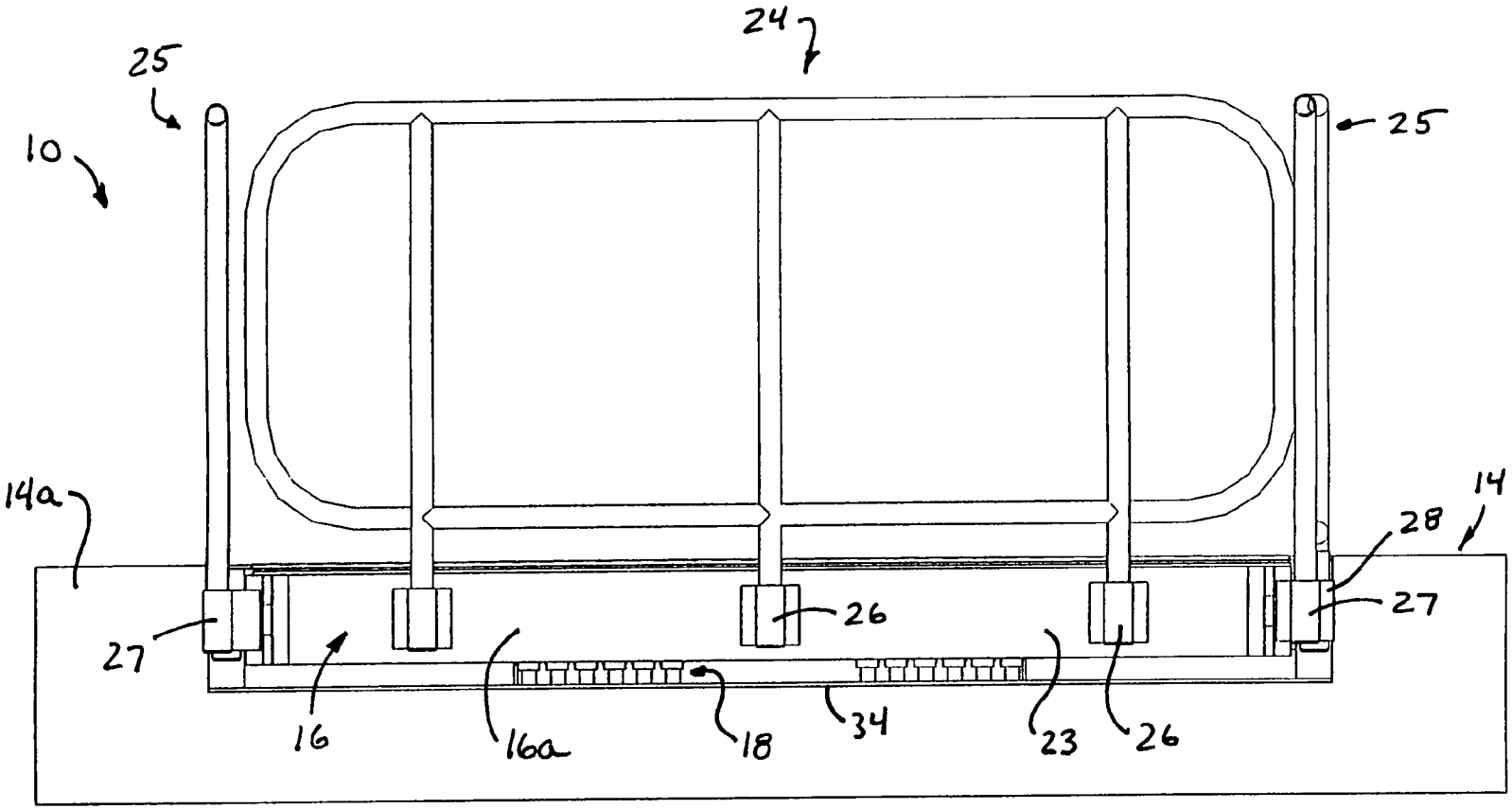
FIG. 12 is a front end elevation of the extendable deck assembly of FIGS. 9-11.

When deck portion 16 is retracted (as shown in FIGS. 5-8), side guard rails 25 and brackets 27 may be positioned such that side guard rails 25 extend along the direction of the front guard rail 24 and in opposite directions from the ends of guard rail 24, whereby the guard rail 24 and side guard rails 25 form a guard rail along the extendable deck assembly and along the platform or tier of the seating area at which extendable deck assembly 10 is positioned. When deck portion 16 is substantially fully extended from base portion 14 (as shown in FIGS. 9-12), locking device or mechanism 22 may secure or lock deck portion 16 relative to base portion 14. In the illustrated embodiment, locking device or mechanism 22 comprises side guard rails 25 of guard rail 24. More particularly, side guard rails 25 and brackets 27 may fold or pivot about pivot pins or axles or hinges 27*a* to position side guard rails 25 along the respective sides of deck portion 16 (as best shown in FIGS. 9 and 10) when deck portion 16 is extended. When deck portion 16 is extended and side guard rails 25 are pivoted to be positioned along the sides of the deck portion 16, side guard rails 25 may further function to secure deck portion 16 in its extended position. For example, an outer post or portion 25*a* of side guard rails 25 may engage or may be at least partially received in receiving pocket or bracket 28 at base portion 14 to retain side guard rails 25 in position along the side portions of deck portion 16 when deck portion 16 is extended from base portion 14. Side guard rails 25 of locking device 22 thus limit or substantially preclude retraction of deck portion 16 when engaged with bracket or brackets 28 of base portion 14.

Figure 13:
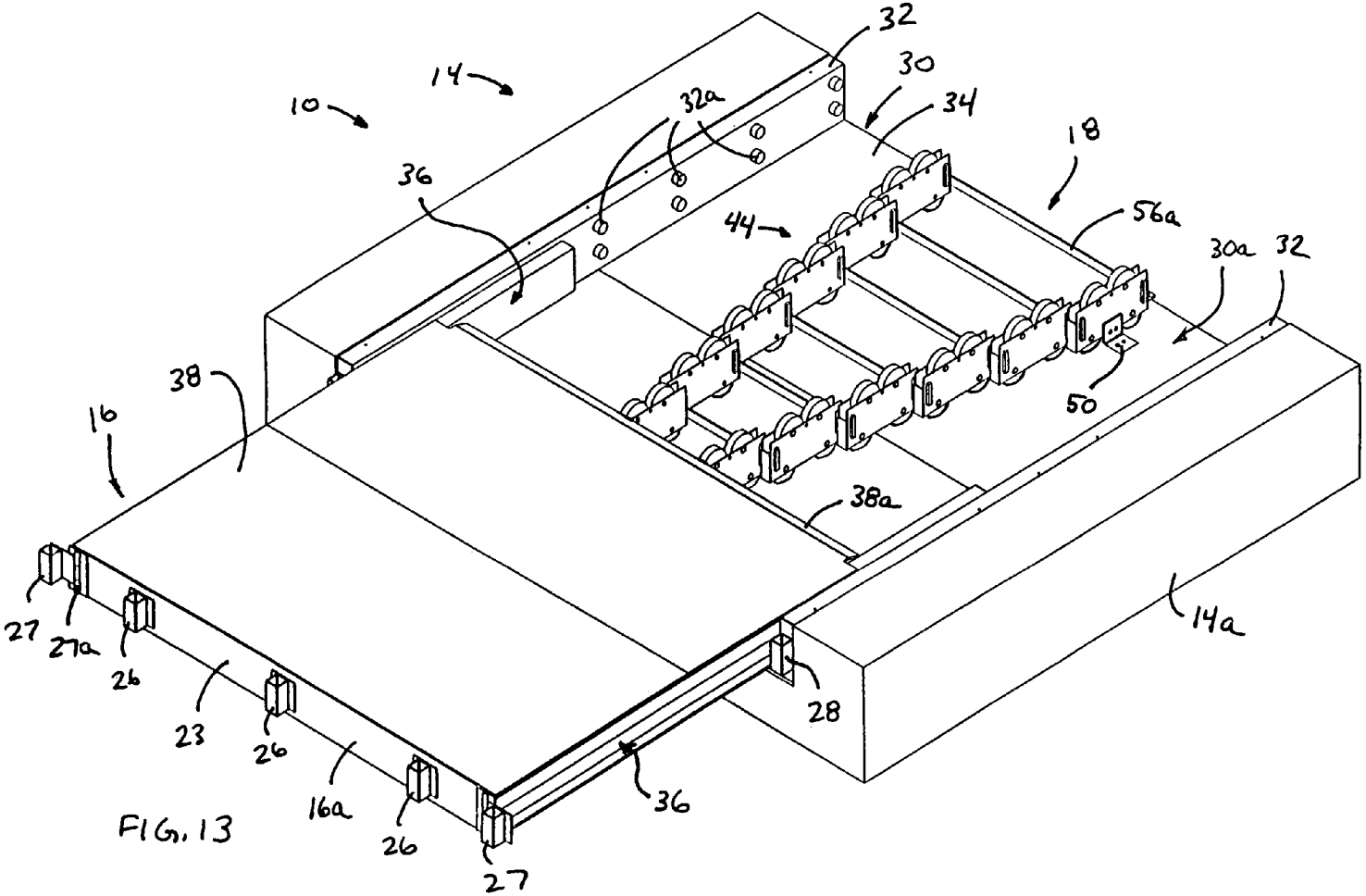
FIG. 13 is a perspective view of the extendable deck assembly of the present invention in its extended orientation, with the cover plate removed from the base portion and with the hand rail or guard rail removed from the extendable deck.
Figure 14:
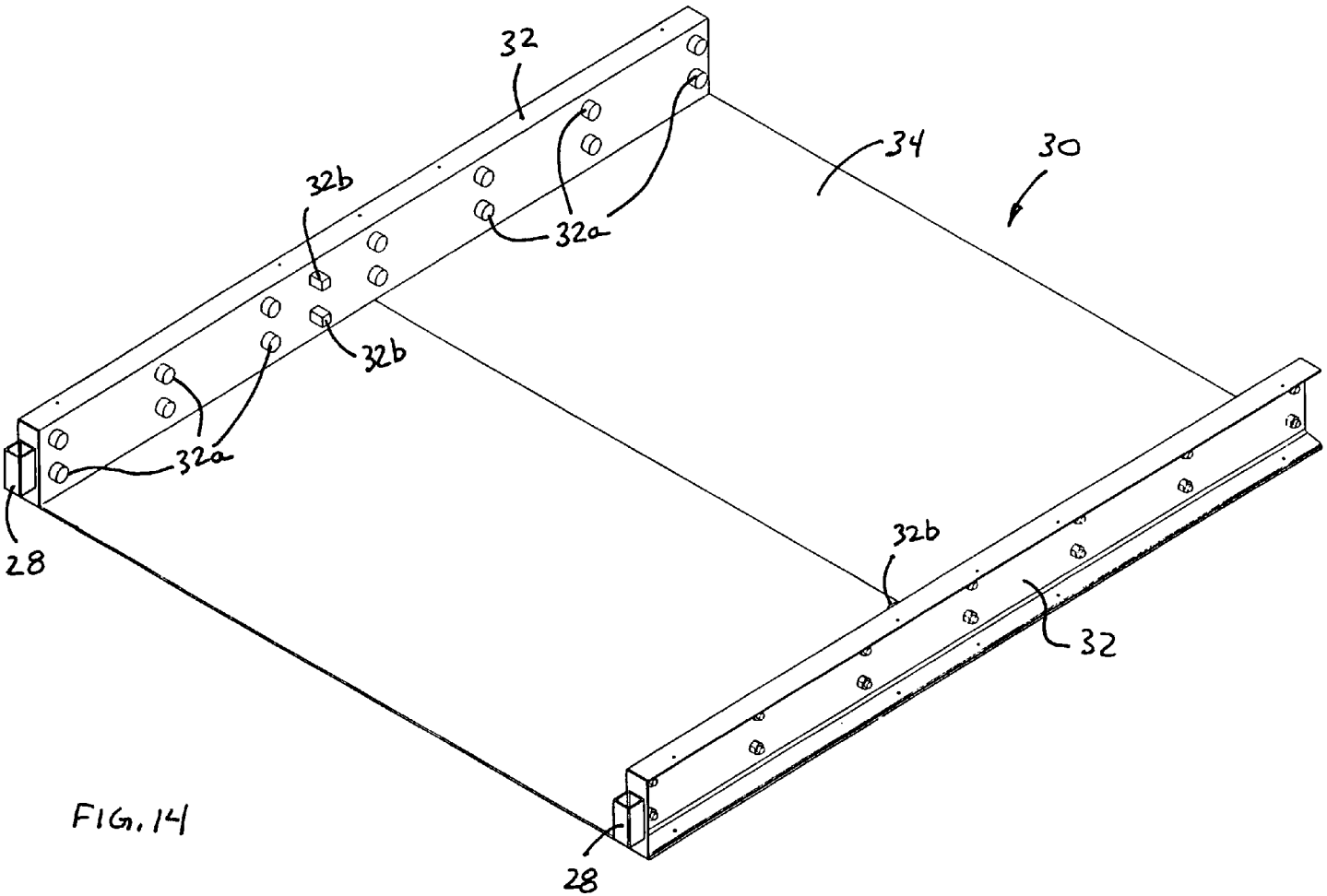
FIG. 14 is a perspective view of the base portion of the extendable deck assembly of FIG. 13.

As best shown in FIG. 13, base portion 14 includes an inner base assembly 30 that is positionable within an outer concrete slab 14*a*, which may comprise a portion of the tier or level 12*a* of the seating area 12. Base portion assembly 30 includes a pair of opposite sides or sidewalls 32 and cover plate 20 extending across and between sides or sidewalls 32. Base assembly 30 may also include a lower surface or panel 34 extending between the sides 32. Accordingly, base assembly 30 may define a cavity 30*a* between sides 32 and between lower panel 34 and cover plate 20. Sidewalls 32 of base portion assembly 30 may include a plurality of rollers 32*a* positioned therealong and spaced vertically apart, such as the sets or pairs of rollers 32*a* shown in FIGS. 13 and 14, for engaging and guiding side members or rails 36 of deck portion 16, as discussed below. Sidewalls 32 may also include one or more stop members or blocks 32*b* (FIGS. 6, 7, 10 and 14) for engaging corresponding stop members or tabs or blocks 36*d* of deck portion 16 to limit outward extension of deck portion 16 relative to base portion 14, as also discussed below. Each sidewall 32 may also include receiving pocket or bracket 28 at its outer end for receiving the post or portion 25*a* of side guard rail 25 when deck portion 16 is extended from base portion 14.

Figure 15:
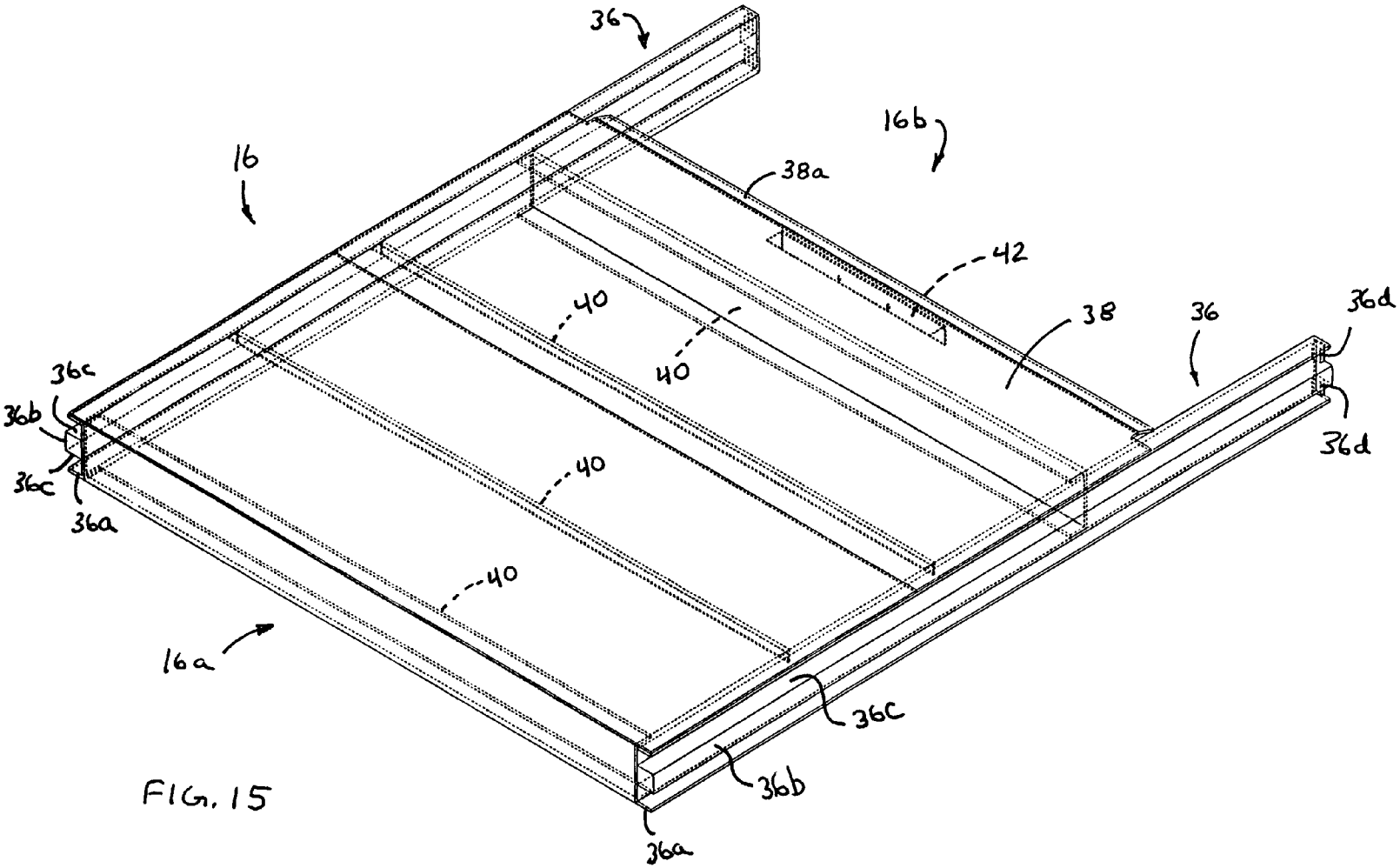
FIG. 15 is a perspective view of the extendable deck of the extendable deck assembly of FIG. 13, with the guard rail mounting brackets removed therefrom.
Figure 16:
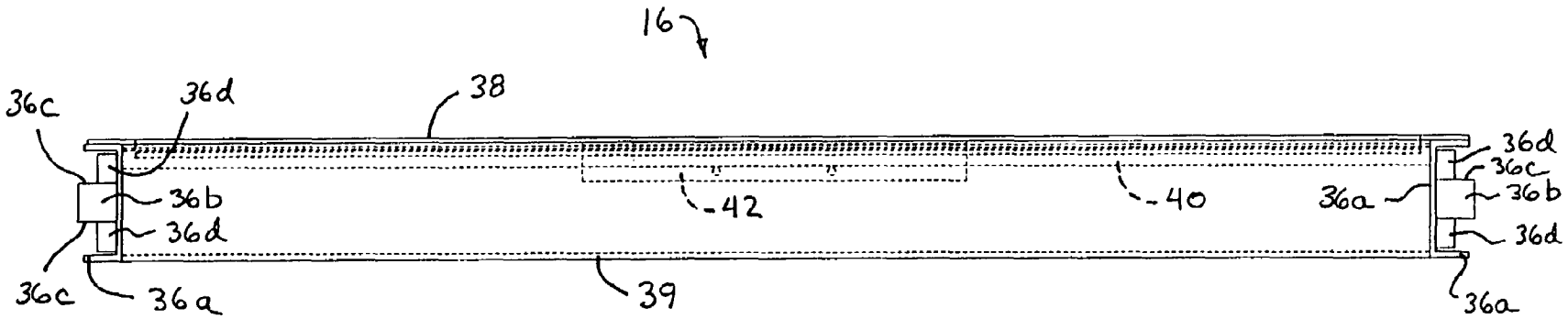
FIG. 16 is a front end elevation of the extendable deck of FIG. 15.

Referring now to FIGS. 15 and 16, deck portion 16 includes a pair of side members or rails 36 extending along opposite sides of deck portion 16 and an upper plate or panel 38 extending between side rails 36 and defining the support surface for deck portion 16 when deck portion 16 is extended from base portion 14. Upper plate or panel 38 may be supported across and between side rails 36 via one or more support members or cross members 40 to provide support to plate or panel 38 to limit or substantially preclude deflection or flexing or bending of panel 38 under loads. When deck portion 16 is retracted, upper panel 38 and cross members 40 function to support cover plate 20 of base portion 14 to limit flexing of cover plate 20 under loads. Support plate or panel 38 may also include a downwardly bent or angled end portion 38*a* at an inner end of panel 38. The downwardly angled or bent portion 38*a* may facilitate guiding the deck portion 16 into cavity 30*a* of base assembly 30 and under cover plate 20 and may further limit or substantially preclude support plate 38 from catching or hooking or snagging any uneven portions of the underside of cover plate 20 as deck portion 16 is retracted into base portion 14. Deck portion 16 may also include a lower panel 39 (FIGS. 7 and 16) extending across deck portion 16 and between side rails 36 and below upper panel 38.

Side rails 36 of deck portion 16 may comprise a generally C-shaped member 36*a* and a rail member 36*b* extending along side rail 36 and having upper and lower generally flat and elongated surfaces 36*c* extending along the rail member 36*b*, such that a pair of channels are defined along side rails 36. The channels defined between the rail member 36*b* and the upper and lower flanges 36*c* of the C-shaped side member 36*a* receive the rollers 32*a* of sides 32 of base portion assembly 30 for guiding and slidably or rollingly moving deck portion 16 relative to base portion 14. The side channels or side rails 36 of deck portion 16 may also include stop tabs or members or blocks 36*d* at an inward end 16*b* of deck portion 16 for contacting stop blocks 32*b* of sidewalls 32 of base portion assembly 30 to limit outward extension of deck portions 16 relative to base portion 14. The rollers 32*a* and rail member 36*b* may cantileverly support deck portion 16 as deck portion 16 is extended from base portion 14. Also, and as best shown in FIG. 15, deck portion 16 may include a support assembly mounting bracket 42 for mounting an outer movable end 18*a* of support assembly 18 to deck portion 16, as discussed below.

As best shown in FIGS. 13 and 17-20, support assembly 18 comprises a plurality of wheeled assemblies or supports 44 that are movable along and between lower surface 34 and cover plate 20 of base assembly 30 as deck portion 16 and support assembly 18 are extended and retracted relative to base portion 14. The supports or wheeled assemblies 44 provide support along and beneath cover plate 20 as extendable deck 16 is extended outwardly from cavity 30*a* of base portion 14 and thus no longer supports cover plate 20. Support assembly 18 includes an inner or fixed or non-movable support 46 and an outer or movable wheeled support 48 and a plurality of movable wheeled supports 50*a*-50*d* positioned between inner or fixed support 46 and outer support 48. Inner support 46 may be fixedly mounted to or attached to base portion 16, such as attached to base or lower panel 34 via one or more brackets 50 or the like. Outer movable support 48 may be attached to an inner portion of deck portion 16, such as attached to bracket 42 of support plate 38 via a corresponding bracket 52 positioned at an outer end of outer movable support 48. Although shown with six wheeled support assemblies, the movable support assembly may have more or fewer wheeled or movable support assemblies, without affecting the scope of the present invention.

Figure 17:
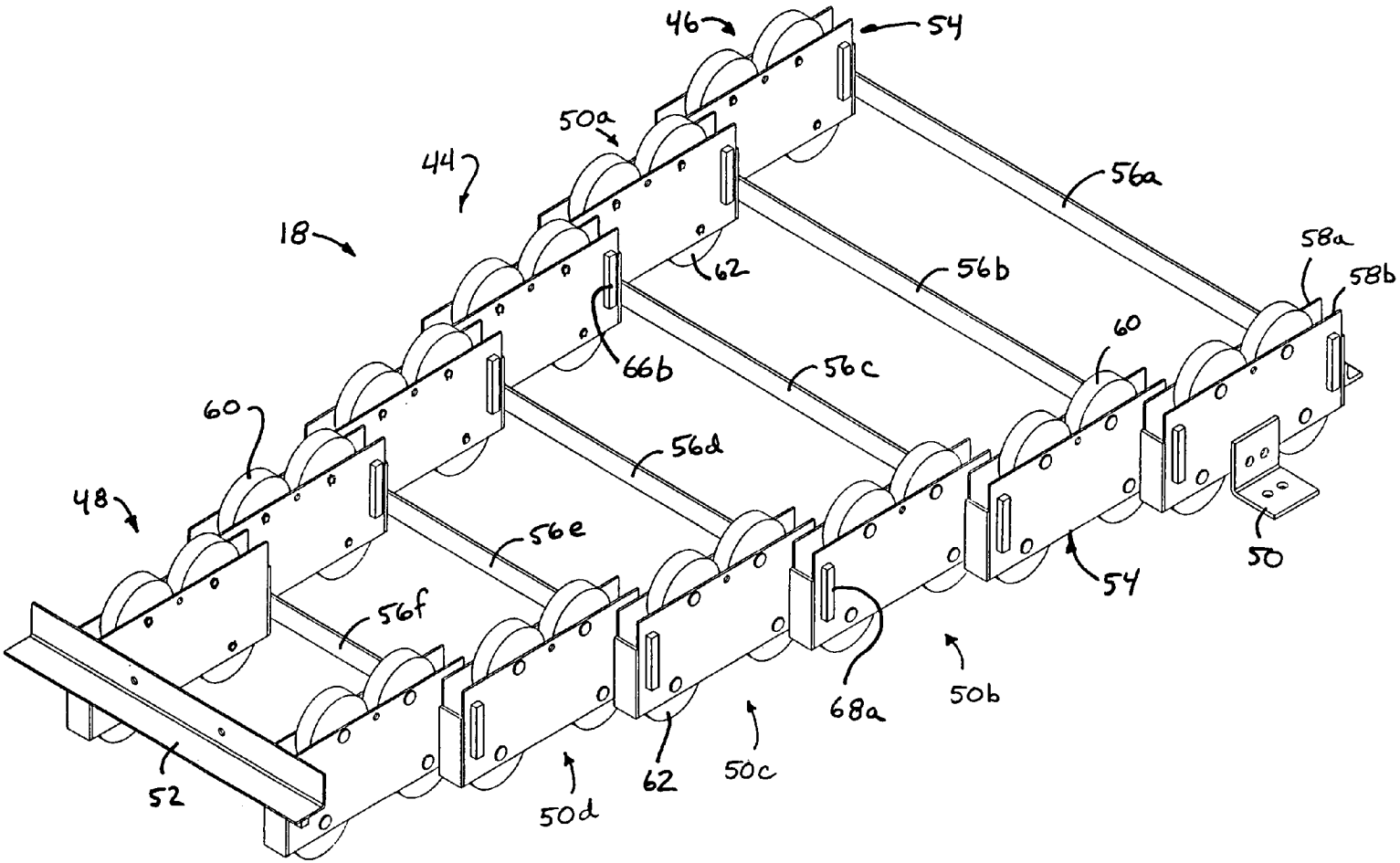
FIG. 17 is a perspective view of a support assembly for supporting the cover plate of the base portion of the extendable deck assembly of the present invention.
Figure 18:
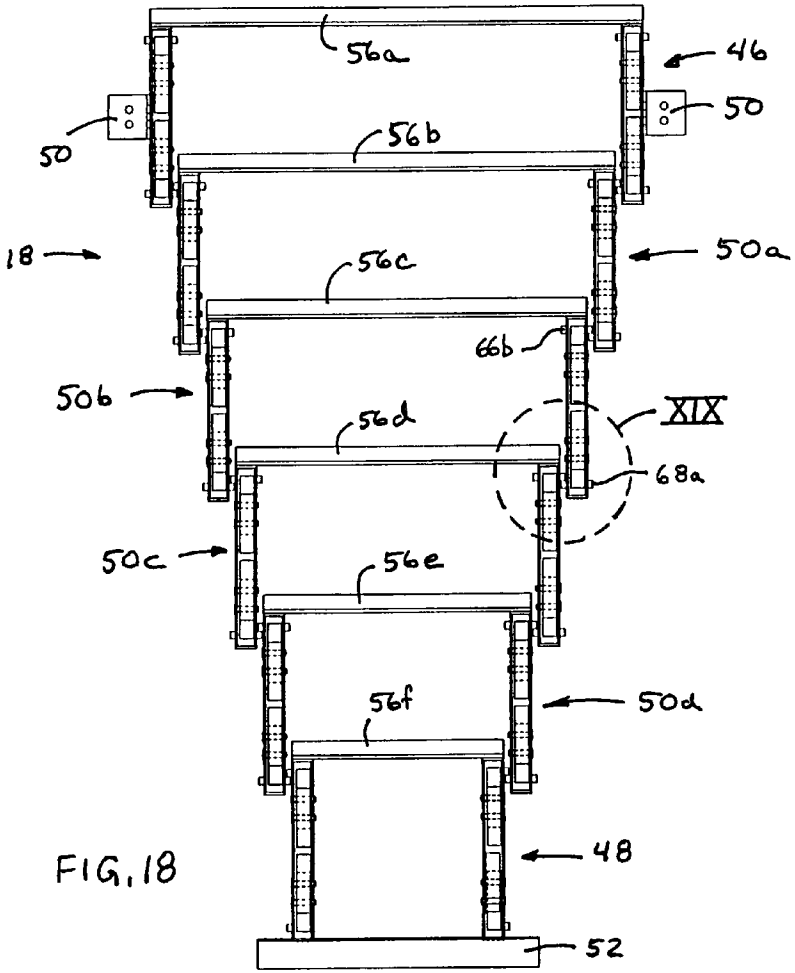
FIG. 18 is a plan view of the support assembly of FIG. 17.
Figure 20:
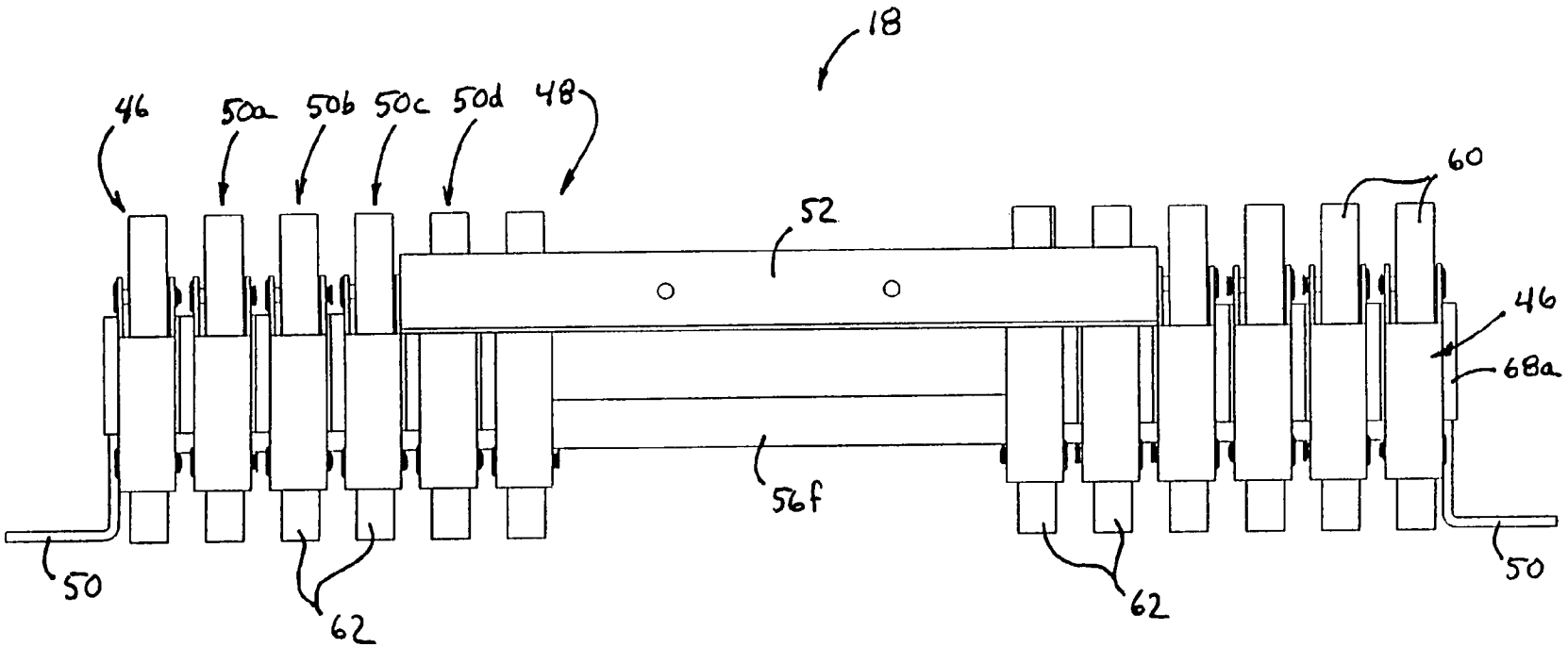
FIG. 20 is a front end elevation of the support assembly of FIGS. 17 and 18.

In the illustrated embodiment, each of the supports 46, 48, 50 comprises a pair of spaced apart side wheel assemblies 54, with each pair or set of spaced apart side wheel assemblies 54 being connected by a respective cross member or bar or rod 56*a-f*. As shown in FIGS. 17 and 18, each of the bars 56*a-f* have a different length to space the respective side wheel assemblies 54 at different distances apart, such that the wheel assemblies may nest within each other (as can be seen with reference to FIGS. 6 and 7). For example, cross member 56*a* of inner or fixed support 46 is larger than cross member 56*b* of the next outwardly positioned movable support 50*a*, while cross member 56*b* is larger than cross member 56*c* of the next outwardly positioned support 50*b*, and so on, with cross member 56*f* of outer support 48 being shorter than the other cross members 56*a-e*.

Figure 21:
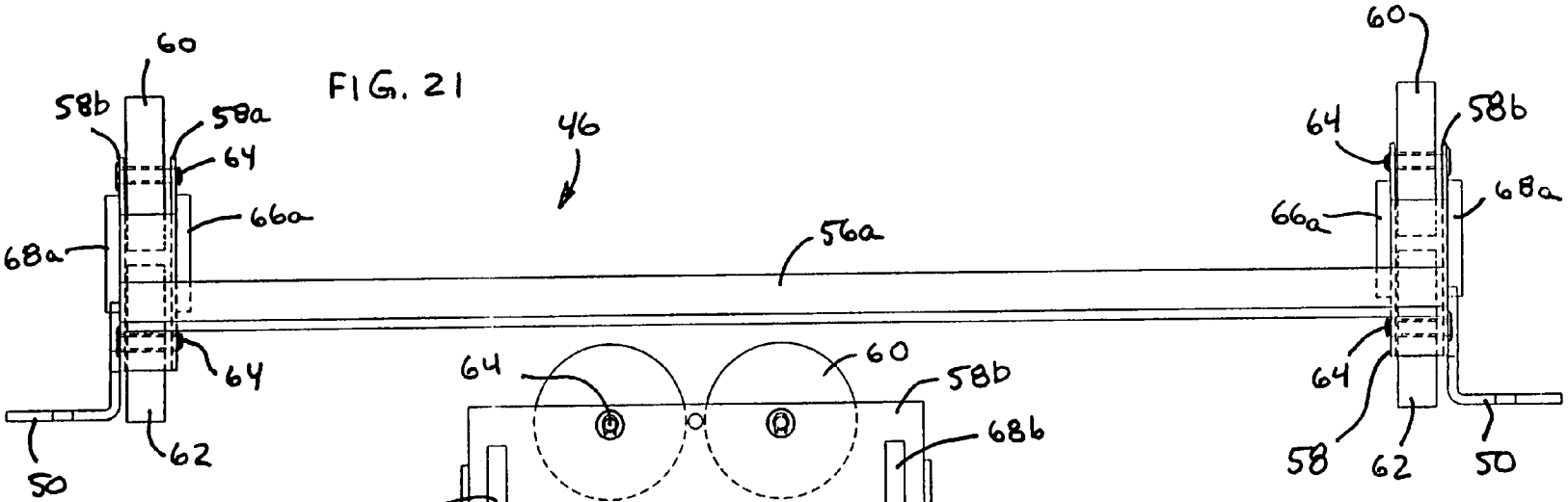
FIG. 21 is an end elevation of the rearward most or fixed support of the support assembly of FIGS. 17, 18 and 20.
Figure 22:
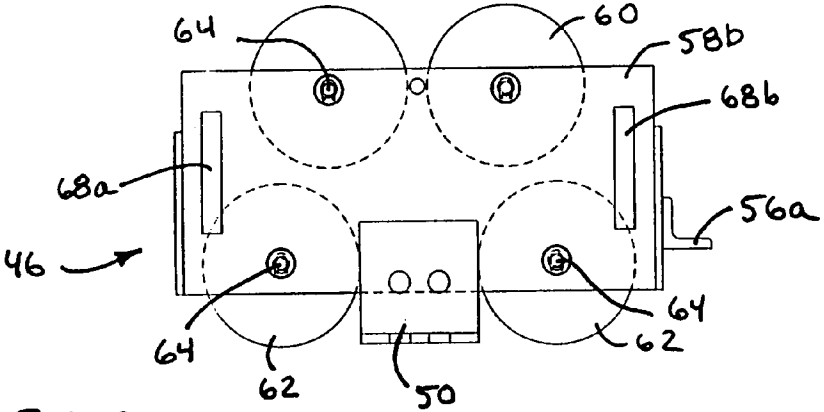
FIG. 22 is a side elevation of the support of FIG. 21.

As best shown in FIGS. 17, 21 and 22, each of the side wheel assemblies 54 of support assembly 18 comprise a pair of side plates 58*a*, 58*b*, which rotatably mount a pair of upper wheels or rollers 60 and a pair of lower wheels or rollers 62. The rollers 60 and 62 may be rotatably mounted to and between sidewalls 58*a*, 58*b* via respective pins or axles 64 extending through the side plates 58*a*, 58*b* and rollers 60, 62. Upper rollers or wheels 60 thus may rollingly engage the lower surface of cover plate 20, while lower rollers 62 may rollingly engage the lower panel or plate 34 to facilitate rolling movement of the supports along and between the lower plate 34 and cover plate 20 of base portion 14. Although shown and described as a pair of upper and lower rollers for each support, it is envisioned that other movable support means may be implemented, without affecting the scope of the present invention. Also, although shown as having wheeled support assemblies, it is further envisioned that the inner or fixed support need not comprise a wheeled assembly for rollingly engaging the lower panel 34 and cover plate 20 of base portion 14, without affecting the scope of the present invention.

Figure 6:
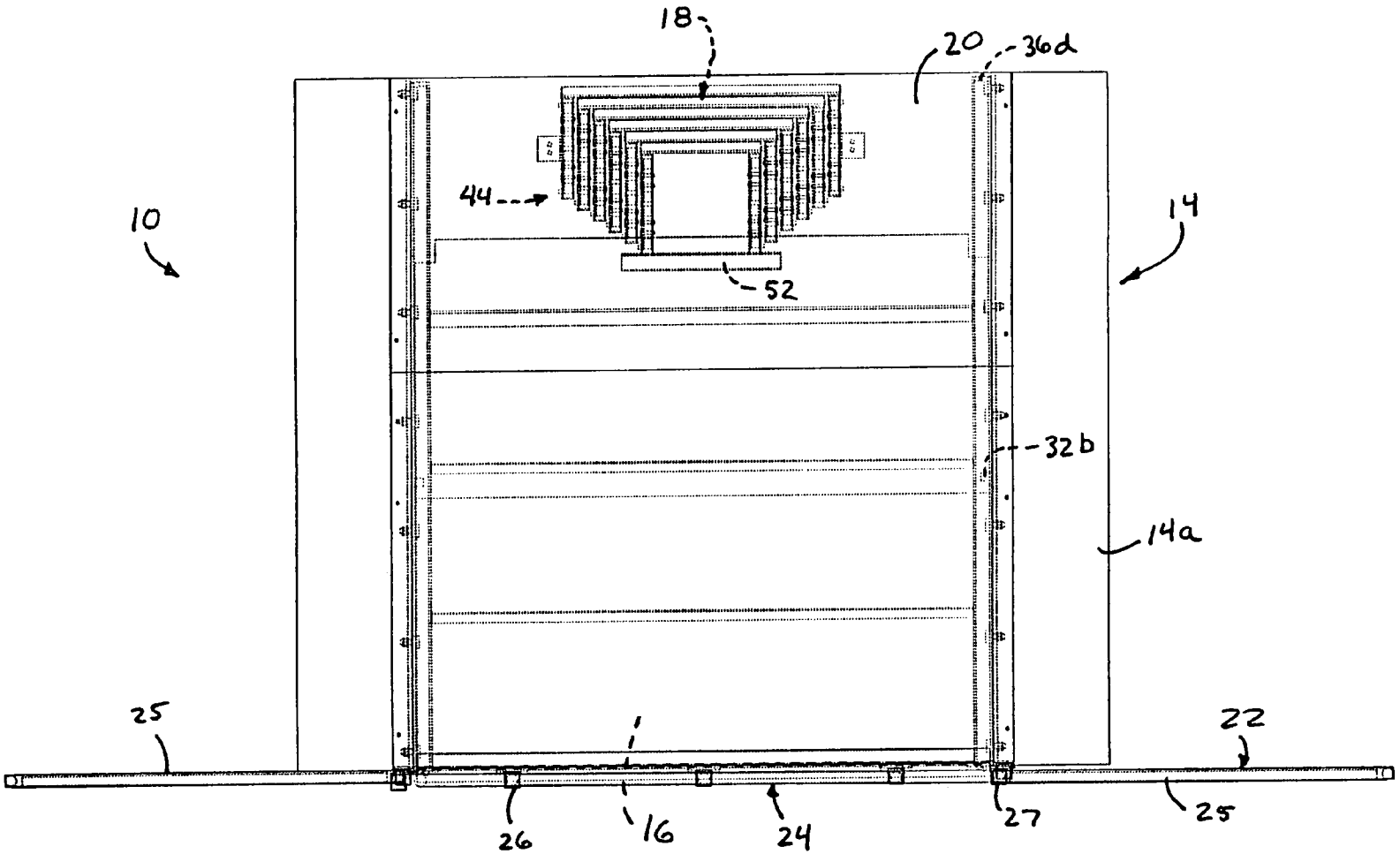
FIG. 6 is a plan view of the extendable deck assembly of FIG. 5.
Figure 7:
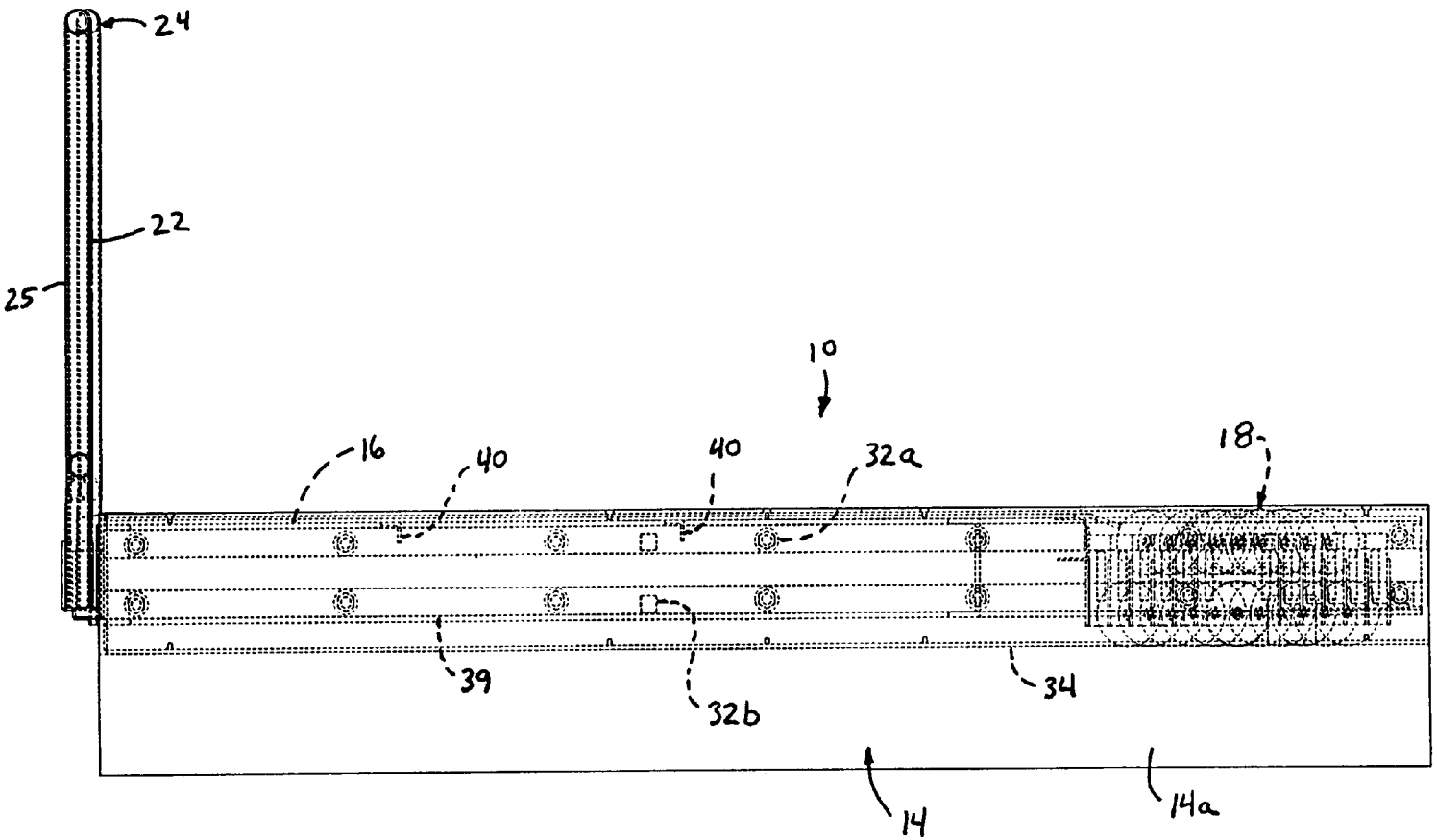
FIG. 7 is a side elevation of the extendable deck assembly of FIGS. 5 and 6.
Figure 8:
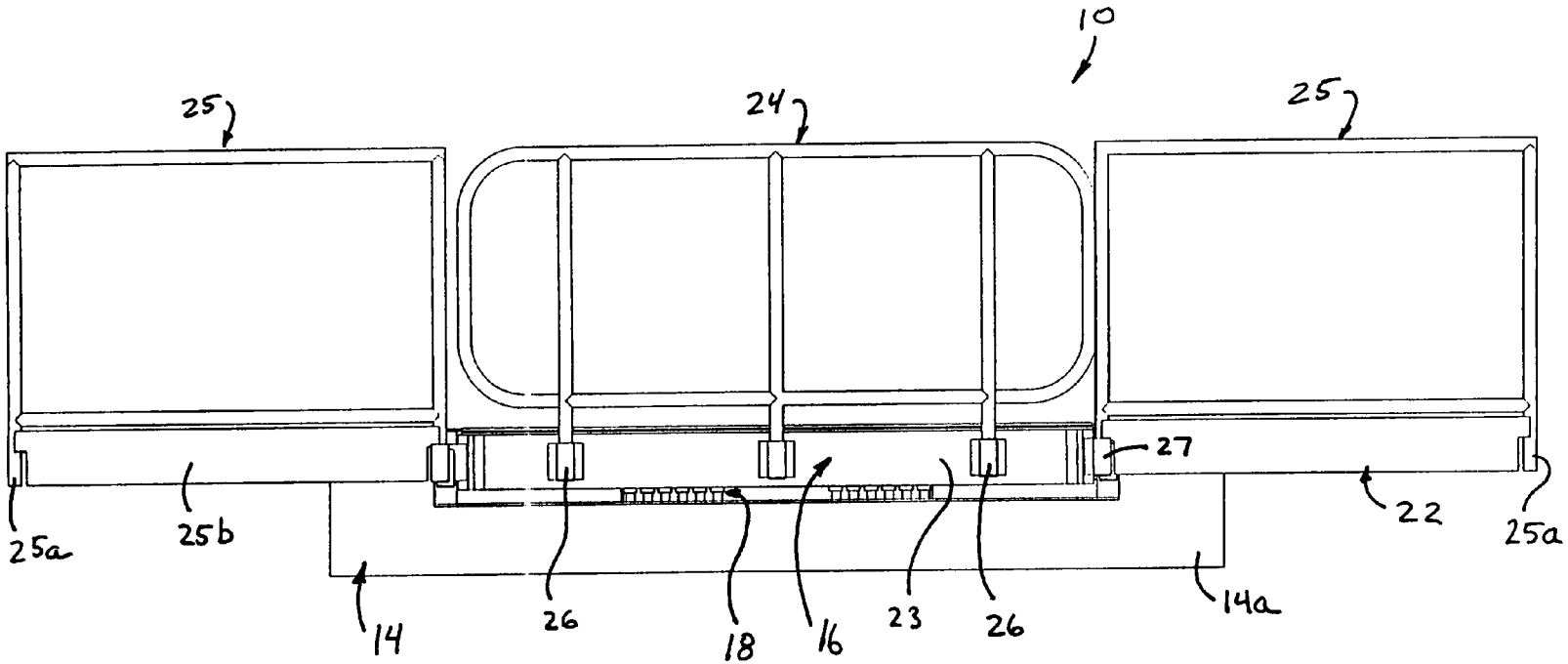
FIG. 8 is front end elevation of the extendable deck assembly of FIGS. 5-7.
Figure 19:
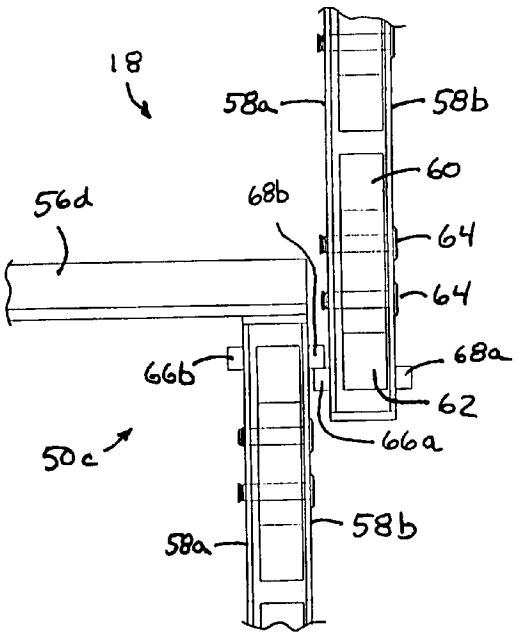
FIG. 19 is an enlarged plan view of the area XIX of FIG. 18.

The movable supports thus may move along and between the cover plate 20 and lower panel 34 of base portion 14 and may move between the side wheel assemblies of the next inner movable support as deck portion 16 is extended and retracted relative to base portion 14. The movable supports are arranged such that they may substantially nest within and between one another when they are retracted (as best shown in FIGS. 6 and 7). As best seen in FIGS. 18 and 19, each of the wheeled assemblies 54 may include a pair of inner stop members 66*a*, 66*b* extending from the inner sidewall 58*a* and a pair of outer stop members 68*a*, 68*b* extending from the outer sidewall 58*b*. The stop members 66*a*, 66*b*, 68*a*, 68*b* engage one another to limit extension and retraction of each movable support relative to the adjacent support or supports. For example, and as can be seen with reference to FIGS. 18 and 19, the rearward outer stop 68*b* of one support engages the forward inner stop 66*a* of the adjacent and inwardly or rearwardly positioned support to limit outward movement or extension of the outer or forward support relative to the inner or rearward support. Likewise, when the supports are retracted, the rearward outer stop 68*b* may engage the rearward inner stop 66*b* of the rearward or inward adjacent support and/or the forward outer stop 68*a* may engage the forward inner stop 66*a* of the rearward adjacent support to limit relative retraction between the supports. The terms "rearward" and "forward" are used herein to indicate inward (toward the inner end of the base portion where the fixed support 46 is attached) and outward (toward the outer end of the deck portion where the receiving bracket 28 is attached), respectively, while the terms "inner stop" and "outer stop" refer to the lateral location or side of the wheeled assembly at which the stop is positioned.

Accordingly, when deck portion 16 is pulled or otherwise moved outwardly from base portion 14, outer support 48 is moved outwardly with deck portion 16 via the connection between bracket 52 of outer support 48 and bracket 42 of deck portion 16. Outer support 48 will move outwardly relative to the next inwardly or rearwardly position support 50*d* until the rear outer stop member 68*b* of outer support 48 engages the front or forward inner stop member 66*a* of movable support 50*d*, whereby further extension of deck portion 16 will cause movable support 50*d* to move outwardly with deck portion 16 and outer support 48. In a similar fashion, the stops of movable support 50*d* will engage the stops of movable support 50*c* to cause outward movement or extension of movable support 50*c*, which in turn will cause extension of the next inward or rearward movable support 50*b*, and so on, until deck portion 16 is fully extended and the movable support assemblies 50*a-d* and 48 are extended relative to one another as shown in FIGS. 17 and 18.

In a similar manner, when deck portion 16 is moved from its extended positioned towards it retracted position, outer support 48 moves inward or rearward with deck portion 16 and causes a corresponding rearward movement of the movable support 50*d* via engagement of its outer stops 68*a* and/or 68*b* with the inner stops 66*a* and/or 66*b* of movable support 50*d*, which in turn moves inwardly to engage and move the next inward or rearwardly positioned movable support 50*c*, and so on, until the supports 48 and 50*a-d* are fully retracted relative to one another and relative to fixed support 46, whereby the supports are nested relative to one another as shown in FIGS. 6 and 7.

The support assembly 18 thus provides support of the cover plate 20 as deck portion 16 is extended from within the cavity 30*a* beneath cover plate 20 of base portion 14. When deck portion 16 is retracted, the nested support assembly 18 supports a rearward or inward portion of cover plate 20, while the upper portion or panel 38 and cross members 40 of deck portion 16 support the rest of cover plate 20. As deck portion 16 is extended from base portion 14, support assembly 18 provides movable support of the cover plate 20 throughout the full range of extension and retraction of deck portion 16. Because cover plate 20 may thus be supported by deck portion 16 and support assembly 18, cover plate 20 does not require cross members or brackets or the like to provide support and structural rigidity to cover plate 20. Deck portion 16 thus may be positioned such that the upper panel 38 of deck portion 16 engages and supports cover plate 20 when deck portion is at least partially within cavity 30*a* of base portion assembly 30. Therefore, when extended from base portion assembly 30*a*, upper panel 38 of deck portion 16 is only slightly below and substantially at the same level of cover plate 20 to provide a substantially level and planar platform along the base portion and extended deck portion. As can be seen with reference to FIGS. 5, 9 and 11, cover plate 20 may include a hinged lip or tab 20*a* at its outer most or forward most end, whereby the tab may bend downward generally into engagement with or slightly above support plate 38 of deck portion 16 to provide a ramp to bridge the slight height difference between support plate 38 and cover plate 20 and to limit or substantially preclude items or articles from being caught between the support plate 38 and cover plate 20 as deck portion 16 is retracted into base portion 14.

Therefore, the present invention provides an extendable deck assembly that may extend a telescoping or nested deck portion from a base portion, while providing support of a cover plate or platform at the base portion. The extendable deck assembly of the present invention thus provides for a substantially smooth or uniform platform, while providing a substantially supported and substantially structurally rigid platform. The present invention also provides a locking mechanism for locking or securing the deck portion in its extendable position relative to the base portion. The locking mechanism may be part of a guard rail assembly positioned at the deck portion. The guard rail assembly may have side guard rails which may pivot or may be arranged along a side portion of the extendable deck portion and may engage a corresponding bracket or portion of the base portion to limit retraction of the deck relative to the base portion. The present invention thus provides an extendable deck or platform that may extend over a seating area when desired and may provide a rigid support platform to accommodate wheel chairs and the like. The extendable deck or platform may be retracted when desired to allow chairs to be positioned or used in the area adjacent to the extendable deck or platform.

Changes and modifications in the specifically described embodiments may be carried out without departing from the principles of the present invention, which is intended to be limited only by the scope of the appended claims, as interpreted according to the principles of patent law.

The invention claimed is:

1. An extendable deck assembly for a seating area having multiple tiers, said extendable deck assembly comprising:

a base portion, said base portion having a lower surface, opposite walls and a cover plate, said cover plate extending across and between said opposite walls and defining an upper surface of said base portion, said base portion defining a cavity between said opposite walls and between said cover plate and said lower surface;

a deck portion, said deck portion being extendable and retractable between a retracted position, where said deck portion is positioned substantially within said cavity of said base portion, and an extended position, where said deck portion is at least partially extended from said base portion; and a support assembly arranged in said cavity of said base portion, said support assembly comprising a fixed end attached to said base portion, a movable end attached to said deck portion and at least one movable support, said at least one movable support being movably engagable with said lower surface of said base portion and with said cover plate of said base portion, said at least one movable support being movable relative to said fixed end and being extendable and retractable when said deck portion is extended and retracted, said at least one movable support being configured to substantially support said cover plate when said deck portion is in said extended position, wherein said at least one movable support comprises a plurality of roller assemblies, each of said roller assemblies having at least one lower roller that rollingly engages said lower surface of said base portion and at least one upper roller that rollingly engages said cover plate.

2. The extendable deck assembly of claim 1, wherein said plurality of roller assemblies are telescopingly movable relative to one another, said roller assemblies being nested together when said deck portion is in said retracted position.

3. The extendable deck assembly of claim 2, wherein said roller assemblies comprise a pair of side assemblies, each side assembly having respective rollers comprising said at least one upper roller and said at least one lower roller, said pair of side assemblies of each of said roller assemblies being connected together via a cross member.

4. The extendable deck assembly of claim 1, wherein said roller assemblies include a stop member, said stop members engaging one another to limit outward movement of said roller assemblies relative to one another.

5. The extendable deck assembly of claim 1 including a locking member that is positionable to substantially limit retraction of said deck portion when said deck portion is in said extended position.

6. The extendable deck assembly of claim 5, wherein said locking member comprises at least one hand rail mountable to and positionable at least partially along said deck portion.

7. The extendable deck assembly of claim 6, wherein said hand rail is configured to engage a receiving member at said base portion when said deck portion is in said extended position to limit retraction of said deck portion.

8. The extendable deck assembly of claim 1, wherein said deck portion is extendable and retractable relative to said base portion via a plurality of rollers on one of opposite sidewalls of said deck portion and said sidewalls of said base portion engaging a rail on the other of said sidewalls of said deck portion and said sidewalls of said base portion.

9. An extendable deck assembly for a seating area having multiple tiers, said extendable deck assembly comprising:

a base portion, said base portion having a lower surface, opposite walls and a cover plate, said cover plate extending across and between said opposite walls and defining an upper surface of said base portion, said base portion defining a cavity between said opposite walls and between said cover plate and said lower surface, wherein said sidewalls and said lower surface of said base portion comprise concrete and said cover plate comprises a metallic material;

a deck portion, said deck portion being extendable and retractable between a retracted position, where said deck portion is positioned substantially within said cavity of said base portion, and an extended position, where said deck portion is at least partially extended from said base portion; and a support assembly arranged in said cavity of said base portion, said support assembly comprising a fixed end attached to said base portion, a movable end attached to said deck portion and at least one movable support, said at least one movable support being movably engagable with said lower surface of said base portion and with said cover plate of said base portion, said at least one movable support being movable relative to said fixed end and being extendable and retractable when said deck portion is extended and retracted, said at least one movable support being configured to substantially support said cover plate when said deck portion is in said extended position.

10. A method for extending a deck portion at a seating area and for supporting a base portion cover when the deck portion is extended, said method comprising:

providing a base portion having a lower surface, opposite walls and a cover plate, said cover plate extending across and between said opposite walls and defining an upper surface of said base portion, said base portion defining a cavity between said opposite walls and between said cover plate and said lower surface;

providing a deck portion that is extendable and retractable between a retracted position, where said deck portion is positioned substantially within said cavity of said base portion, and an extended position, where said deck portion is at least partially extended from said base portion;

at least partially supporting said cover plate of said base portion with said deck portion when said deck portion is in said retracted position; and extending said deck portion and supporting said cover plate of said base portion with a movable support assembly when said deck portion is at least partially extended from said base portion;

wherein supporting said cover plate comprises supporting said cover plate with a movable support assembly comprising at least one wheeled support assembly arranged in said cavity of said base portion and inward of said deck portion, said movable support assembly being movably engagable with said lower surface of said base portion and said cover plate of said base portion when said deck portion is extended, wherein said at least one wheeled support assembly comprises at least one lower wheel that rollingly engages said lower surface of said base portion and at least one upper wheel that rollingly engages said cover plate as said deck portion is extended and retracted relative to said base portion.

11. The method of claim 10 including locking said deck portion in said extended position.

12. The method of claim 11, wherein locking said deck portion comprises locking said deck portion relative to said base portion with a side guard rail assembly that is positionable between mounting portions of said deck portion and said base portion when said deck portion is extended.

13. An extendable deck assembly for a seating area having multiple tiers, said extendable deck assembly comprising:

a base portion, said base portion having a lower surface, opposite walls and a cover plate, said cover plate extending across and between said opposite walls and defining an upper surface of said base portion, said base portion defining a cavity between said opposite walls and between said cover plate and said lower surface;

a deck portion, said deck portion being extendable and retractable between a retracted position, where said deck portion is positioned substantially within said cavity of said base portion, and an extended position, where said deck portion is at least partially extended from said base portion, said deck portion providing support to said cover plate when said deck portion is in said retracted position; and a support assembly arranged in said cavity, said support assembly comprising a fixed end attached to said base portion, a movable end attached to said deck portion and a plurality of roller assemblies between said fixed end and said movable end, each of said roller assemblies having a lower roller that rollingly engages said lower surface of said base portion and an upper roller that rollingly engages said cover plate, said roller assemblies being movable relative to said fixed end and being extendable and retractable when said deck portion is extended and retracted, said roller assemblies being configured to substantially support said cover plate when said deck portion is in said extended position.

14. The extendable deck assembly of claim 13, wherein said movable end comprises an outer roller assembly.

15. The extendable deck assembly of claim 13, wherein said fixed end comprises an inner roller assembly.

16. The extendable deck assembly of claim 13, wherein said plurality of roller assemblies are telescopingly movable relative to one another, said movable roller assemblies being nested together when said deck portion is retracted.

17. The extendable deck assembly of claim 16, wherein said roller assemblies comprise a pair of side assemblies, each side assembly having said upper roller and said lower roller, said pair of side assemblies of each of said roller assemblies being connected together via a cross member.

18. The extendable deck assembly of claim 17, wherein said cross members of each of said plurality of roller assemblies have different lengths, whereby each of said plurality of roller assemblies has a different width defined by the respective cross member, said roller assemblies having widths that are greater than the next outer roller assembly.

19. The extendable deck assembly of claim 13, wherein said roller assemblies comprise a pair of upper rollers that engage said cover plate and a pair of lower rollers that engage said lower surface.

20. The extendable deck assembly of claim 13, wherein said rollers assemblies include a stop member, said stop members engaging one another to limit outward movement of said roller assemblies relative to one another.

21. The extendable deck assembly of claim 13 including a locking member that is positionable to substantially limit retraction of said deck portion when said deck portion is in said extended position.

22. The extendable deck assembly of claim 21, wherein said locking member comprises at least one hand rail mountable to and positionable at least partially along said deck portion and engagable with said base portion when said deck portion is in said extended position.

23. An extendable deck assembly or platform for a seating area having multiple tiers, said extendable deck assembly comprising:

a base portion, said base portion having a lower surface, opposite walls and a cover plate, said cover plate extending across and between said opposite walls and defining an upper surface of said base portion, said base portion defining a cavity between said opposite walls and between said cover plate and said lower surface;

a deck portion, said deck portion being extendable and retractable between a retracted position, where said deck portion is positioned substantially within said cavity, and an extended position, where said deck portion is at least partially extended from said base portion;

a support assembly arranged in said cavity, said support assembly comprising at least one movable support, said at least one movable support being movable relative to said base portion and being extendable and retractable with said deck portion, said at least one movable support being configured to substantially support said cover plate when said deck portion is extended, wherein said at least one movable support comprises at least one roller assembly having a lower roller that rollingly engages said lower surface of said base portion and an upper roller that rollingly engages said cover plate; and a locking assembly for limiting retraction of said extendable deck portion relative to said base portion when said deck portion is in said extended position.

24. The extendable deck assembly of claim 23, wherein said locking assembly comprises a side guard rail assembly that is positionable at least partially along a side of said deck portion and is engagable with a mounting portion at said deck portion and a mounting portion at said base portion when said deck portion is in said extended position.

25. The extendable deck assembly of claim 24, wherein said side guard rail assembly is adjustably mountable at said deck portion and is adjustable to be positioned at least partially along a side of said deck portion and toward said base portion when said deck portion is in said extended position.

26. The extendable deck assembly of claim 23, wherein said deck portion at least partially supports said cover plate when said deck portion is in said retracted position.

* * * * *